US006253826B1

(12) United States Patent
Witter et al.

(10) Patent No.: US 6,253,826 B1
(45) Date of Patent: Jul. 3, 2001

(54) FOLDING DOOR FOR OFFICE CUBICLE

(76) Inventors: Charles H. Witter; Vivian R. C. Witter, both of 8420 Baring Ave., Munster, IN (US) 46321

( * ) Notice: Subject to any disclaimer, the term of this patent is extended or adjusted under 35 U.S.C. 154(b) by 0 days.

(21) Appl. No.: 09/500,258

(22) Filed: Feb. 8, 2000

(51) Int. Cl.[7] ..... E05D 15/26

(52) U.S. Cl. ..... 160/213; 160/DIG. 16; 292/251.5

(58) Field of Search ..... 160/213, 210, 160/206, 199, 231.1, 231.2, 135, 370.23, 84.01, DIG. 16; 292/251.5, DIG. 17; 52/239, 71, 36.1

(56) References Cited

U.S. PATENT DOCUMENTS

| | | | | |
|---|---|---|---|---|
| 3,418,666 | * | 12/1968 | Rockey | 160/231.1 X |
| 3,422,878 | | 1/1969 | Galietti . | |
| 3,799,237 | * | 3/1974 | Proserpi | 160/199 |
| 3,979,861 | | 9/1976 | Fromme . | |
| 4,276,919 | * | 7/1981 | Waters | 160/199 X |
| 4,534,395 | | 8/1985 | Carrol . | |
| 4,924,931 | | 5/1990 | Miller . | |
| 5,214,885 | * | 6/1993 | Maas et al. | 52/239 X |
| 5,275,220 | * | 1/1994 | Siegal | 160/24 |
| 5,282,341 | | 2/1994 | Balogna . | |
| 5,287,909 | | 2/1994 | King . | |
| 5,392,834 | | 2/1995 | Borgart . | |
| 5,675,946 | | 10/1997 | Verbeek . | |
| 5,687,513 | | 11/1997 | Balogna . | |
| 5,762,123 | | 6/1998 | Koyama . | |
| 5,896,718 | | 4/1999 | Westgarth . | |
| 6,012,504 | * | 1/2000 | Siegal | 160/24 |

* cited by examiner

*Primary Examiner*—David M. Purol

(57) ABSTRACT

The folding door for an office cubicle provides an inexpensive, universally applicable mechanism for selectively opening and closing the entryway of an office cubicle. The folding door comprises an accordion-style folding door panel (1) fabricated from a sheet of lightweight, semi-rigid material with a plurality of specifically aligned magnetic fasteners (30) attached to both surfaces. The folding door panel (1) is pivotally attached to a partition jamb (14) adjacent the entryway by a vertical hinge (8) attached along one panel edge (6). The opposite panel edge (13) includes a dual latching handle member (18) which is used to selectively secure the door when unfolded in the closed entryway position and to retain the door out of the entryway when folded in the open entryway position.

17 Claims, 10 Drawing Sheets

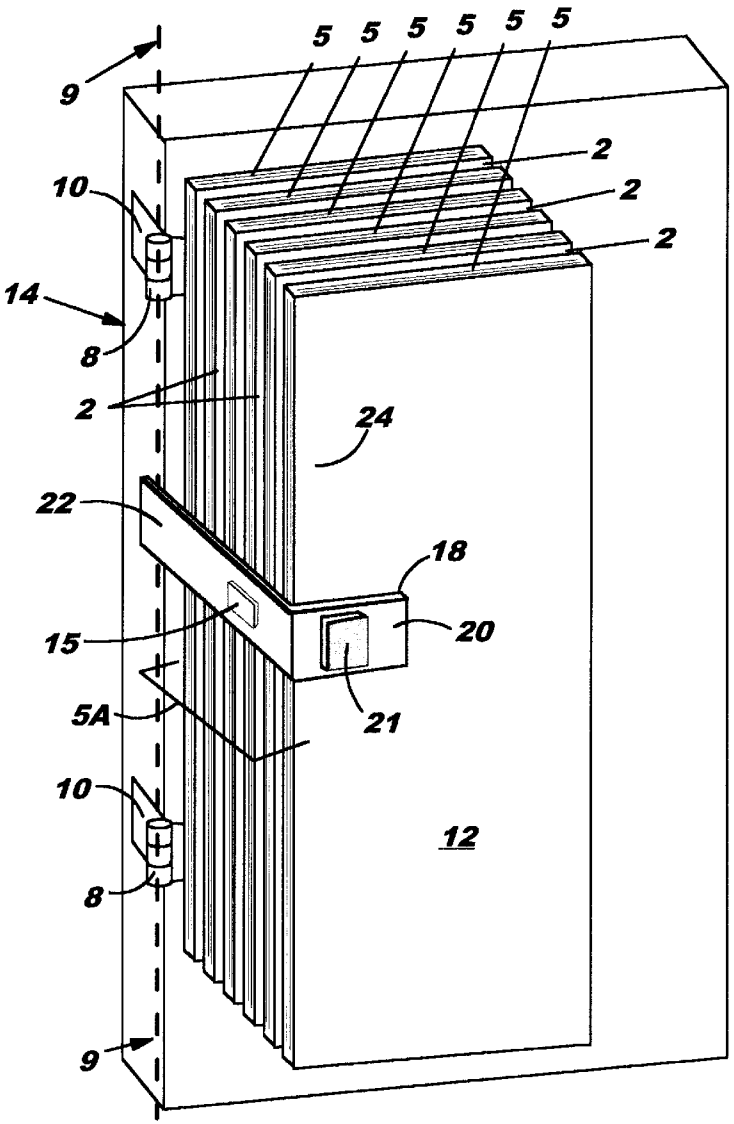
FIG. 2A
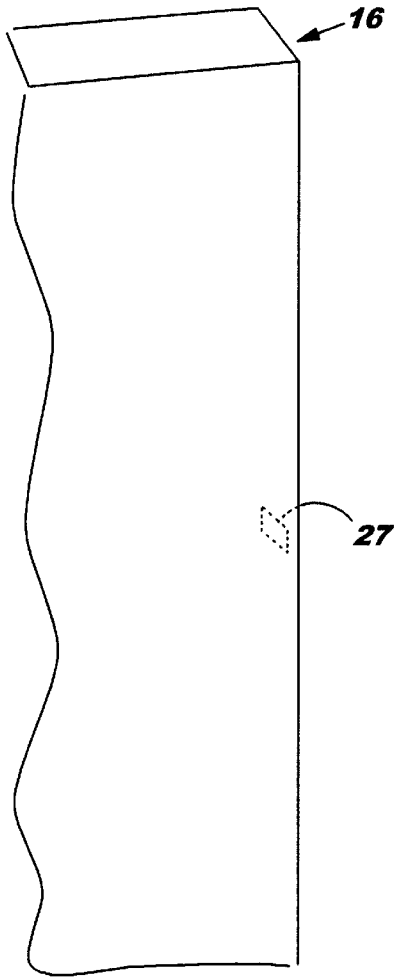

FOLDING DOOR FOR OFFICE CUBICLE

BACKGROUND

1. Field of Invention

The present invention relates to office partition systems and in particular to a folding door that can be secured to a partition wall, adjacent an entryway, to allow selective closure of the entryway.

BRIEF SUMMARY

2. Description of Prior Art

In the modern office environment, partition systems are commonly used to divide large open areas into rows of adjacent cubicles that are separated by commonly shared aisles. A typical office cubicle is a rectangular configuration of partition walls in which an open space is left between two partition sections, facing the common aisle, to allow user entry. This typical design pattern provides the cubicle user with a constant source of peripheral distractions and ad-hoc interruptions stemming from coworkers using the common aisle.

It would therefore be desirable to provide a simple mechanism for closing the entryway in order to eliminate these peripheral distractions and in particular, a universally applicable mechanism which does not require modification of the cubicle and that users can personally afford, transport and install themselves.

Some workspace modules such as is described in U.S. Pat. No. 5,687,513 (1997) and U.S. Pat. No. 5,282,341 (1994) to Baloga include doors that have been specifically designed to function within their respective modular systems. These doors are shaped to fit a pre-determined entryway and are supported by a specific panel construction. Thus, these doors do not provide a universal solution for the installed base of office cubicles.

Folding screens of the floor standing type such as described in U.S. Pat. No. 5,896,718 (1999) to Westgarth, U.S. Pat. No. 5,287,909 (1994) to King and U.S. Pat. No. 4,924,931 (1990) to Miller are not ergonomically functional as a cubicle door. Employing these screens on a daily basis would be tedious because a user would be required to lift, unfold and carefully position the screen each time the user wanted close the entryway and to lift, fold and remove the screen each time the user wanted to open the entryway.

U.S. Pat. No. 5,675,946 (1997) to Verbeek describes a privacy screen for workspaces using a framed LEXAN panel supported by one or more telescopic slides attached to a side panel using a bracketed mechanism. The solution provided by Verbeek is not accessible to many users because the expensive construction prohibits an out of pocket purchase. Because of the expense, a potential user would be forced to seek budget approval from management for the screen. In addition, installation of the Verbeek screen is complicated because it requires panel specific mounting brackets and the use of tools to install fasteners. Finally, its three to four foot panel width significantly inhibits transport by an average user to the workplace.

The folding doors of prior art are not generally applicable as an inexpensive, universal, office cubicle door because they fail to address the specific constraints and ergonomic requirements associated with cubicle construction and modular office layout common in the workplace.

A primary design factor is that cubicle openings lack the lintel means required by many folding door designs. The designs proposed in U.S. Pat. No. 5,762,123 (1998) to Kuyama, U.S. Pat. No. 5,392,834 (1995) to Borgart, and U.S. Pat. No. 3,979,861 (1976) to Fromme as well as the design revealed by Galietti in U.S. Pat. No. 3,422,878 (1969) reference a lintel means for support during extension. In modular office systems, a partition height of five feet is very common. Installing track acting as a lintel means across the entryway would effectively block the entryway. Thus, these designs are not readily applicable for use as a cubicle door because the entryway lacks the required lintel means.

Another key design constraint is the desire to not make permanent modifications to partitions because invasive modifications, such as drilling holes, inhibits future reuse of the disfigured partition section. Minimizing weight was not the primary objective of the previously described folding doors or of the folding door described in U.S. Pat. No. 4,534,395 (1985) to Carroll. Thus, these doors cannot be supported in an extended manner without using an embedded hardware fastener to attach the hinge to the jamb. Thus, these designs are not an optimal solution as a folding door for an office cubicle.

Finally, the previously described folding doors contain expensive features, which are not applicable to office cubicles. The Carroll and Kuyama doors have automatic opening and release mechanisms, the Borgardt door has a break-away feature, the Fromme door has tension spring assembly and the Galietti door has a framed, double panel construction all of which are not relevant or useful features for office cubicle doors.

SUMMARY

In accordance with the present invention, a folding door for an office cubicle comprises an accordion-style folding door panel including a plurality of surface mounted magnets, a plurality of vertical hinges attached along one panel edge and a dual-sided latching member attached to the opposite panel edge which is used to selectively secure the door panel when the door panel is unfolded in the closed entryway position and to retain the door panel out of the cubicle entryway when the door is folded in the open entryway position.

OBJECTS AND ADVANTAGES

According, several objects and advantages of the present invention are:

(a) to provide a cubicle door which can be used with the vast majority of existing office partition systems regardless of panel height or thickness;

(b) to provide a cubicle door which is inexpensive and can be purchased by an average office worker;

(c) to provide a cubicle door which can be easily installed without tools by an average office worker;

(d) to provide a lightweight cubicle door which can be deployed without permanent modification to the office partition system; and (e) to provide a cubicle door which is portable and can be readily removed or reinstalled on demand.

Further objects and advantages are to provide a cubicle door which takes up minimal space when not in use, requires minimal swing space to operate, and can be decorated en masse using an inexpensive standard printing method. Still further objects and advantages will become apparent from a consideration of the ensuing description and drawings.

DRAWING FIGURES

In the drawings:

FIG. 1C is an elevation view illustrating the fold line pattern applied to the folding door panel;

FIG. 1D is a detailed view of the dual latching handle member;

FIG. 2A is a perspective view of the folding door in an open entryway position viewed from the interior of the cubicle;

REFERENCE NUMERALS IN DRAWINGS

Figure 1A:
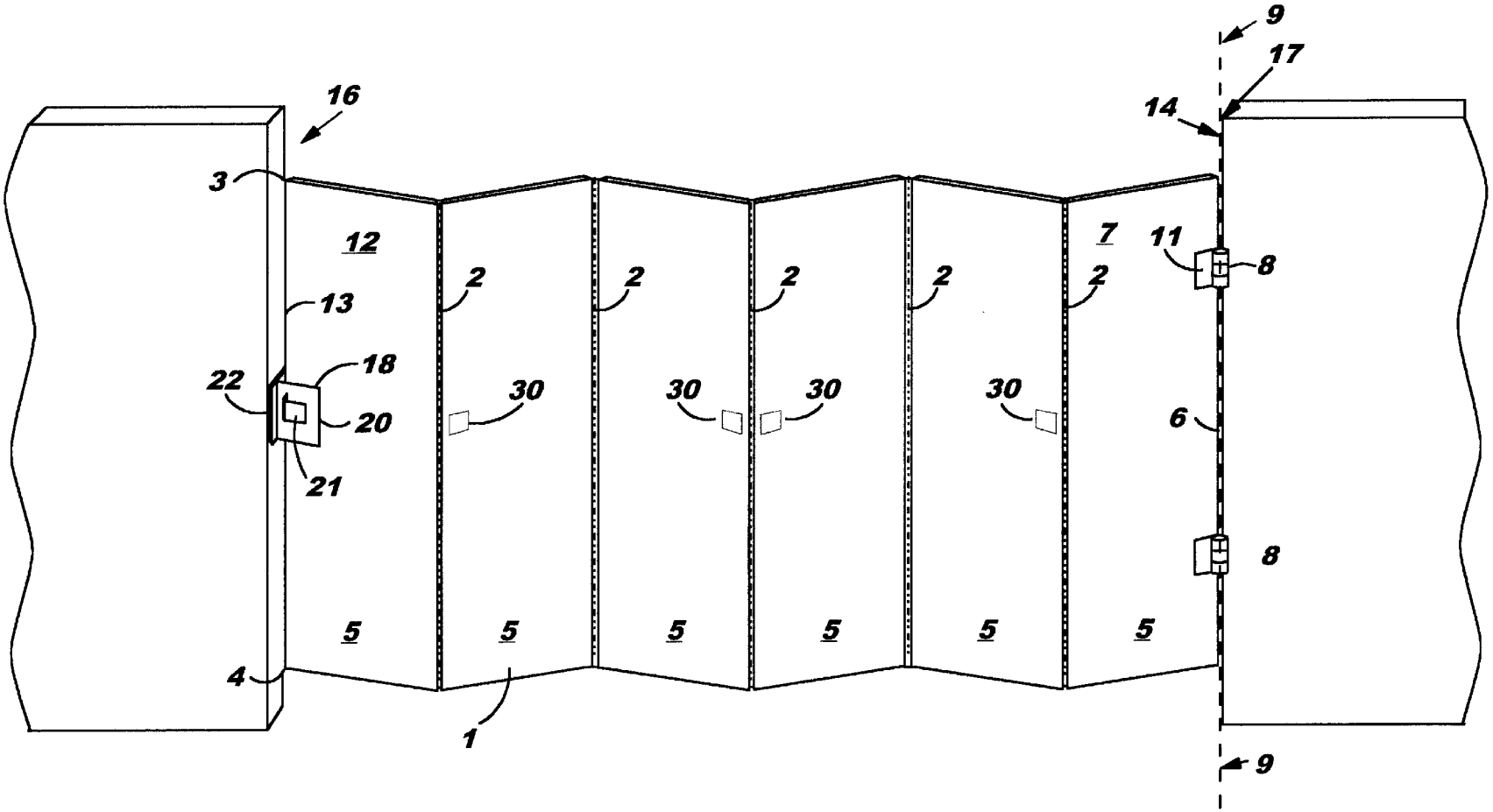
FIG. 1A is a perspective view of the folding door in a closed entryway position viewed from the interior of the cubicle.

| | |
|---|---|
| 1 folding door panel | 2 foldable joint lines |
| 3 panel top edge | 4 panel bottom edge |
| 5 panel element | 5A compressed stack of panel elements |
| | 6 hinge edge |
| 7 hinge panel | 8 hinge |
| 9 hinge pivotal axis | 10 jamb hinge leaf |
| 11 panel hinge leaf | 12 handle panel |
| 13 handle edge | 14 hinge jamb |
| 15 detachable fastener | 16 handle jamb |
| 17 interior hinge jamb corner | 18 dual latching handle member |
| 19 dual latching plane | 20 door handle grip plane |
| 21 door handle grip | 22 closed door latching surface |
| 23 open door retaining surface | 24 rigid channel |
| 25 offset latching surface | 26 exterior hinge jamb corner |
| 27 mating detachable fastener | 28 offset latching handle |
| 29 dual latching plane grip | 30 magnetic fastener |

DETAILED DESCRIPTION OF THE PREFERRED EMBODIMENT

As illustrated in FIG. 1C, a preferred embodiment of the folding cubicle door of the present invention has a folding door panel 1 fabricated from a foldable sheet of semi-rigid material that is thin and lightweight such as corrugated cardboard or corrugated plastic. Rigid channels 24 are integrally attached to the hinge edge 6 and the handle edge 13 of the foldable sheet of semi-rigid material. These channels prevent the edges from fraying and provide additional longitudinal rigidity to the folding door panel 1.

The folding door panel 1 has a plurality of parallel foldable joint lines 2 impressed and perforated into alternate sides of the material stretching from the panel top edge 3 to the panel bottom edge 4. The foldable joint lines 2 partition the sheet of material into a series of contiguous panel elements 5. A series of horizontally aligned magnetic fasteners 30 are integrally attached to both sides of the folding door panel 1 along the panel edges 6,13 and along the foldable joint lines 2 in the pattern shown in FIG 1C.

Figure 2B:
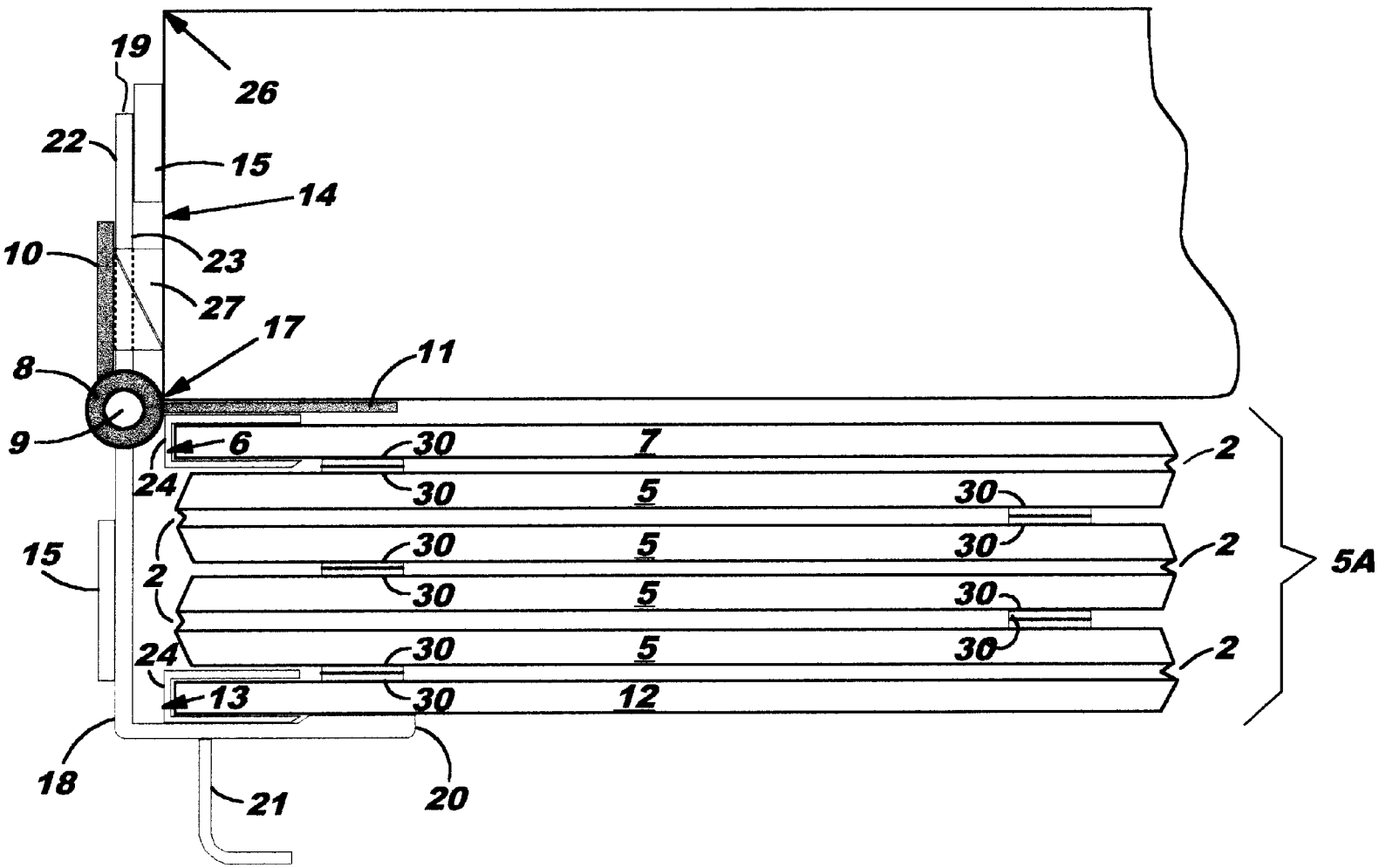
FIG. 2B is a top view of the folding door in an open entryway position.

Turning to FIGS. 2A and 2B, the foldable joint lines 2 are impressed and perforated into alternate sides of the material so that the folding door panel can be collapsed, in accordion style, to yield a flat, compressed stack of panel elements 5A. When the folding door panel 1 is positioned as a compressed stack of panel elements 5A, each magnetic fastener 30 is aligned with an opposite and the attraction serves to releasably retain the folding door panel 1 in the compressed configuration. A plurality of hinges 8 are integrally attached to the outer surface of the hinge panel 7 along the hinge edge 6. Each hinge 8 is positioned along the hinge edge 6 so that the hinge pivotal axis 9 is aligned parallel to the hinge edge 6.

At the opposite edge of the folding door panel 1, the dual latching handle member 18 is positioned such that the dual latching plane 19 is perpendicularly extended beyond the hinge edge 6 of the compressed panel stack. The door handle grip plane 20 surface of the dual latching handle member 18 is integrally attached to the outer surface of the handle panel 12 along the handle edge 13. The door handle grip 21 is positioned parallel to the handle edge 13 and remains on the outermost surface of the compressed stack of panel elements SA when the folding door panel 1 is collapsed as is also shown in FIG. 2B.

A detailed illustration of the dual latching handle member 18 is shown in FIG. 1D. The illustration shows the closed door latching surface 22 and the open door retaining surface 23 having integrally connected detachable fasteners 15 which are used to retain the folding door panel 1 in the closed (FIGS. 1A and 1B) and open entryway positions (FIGS. 2A and 2B) respectively. If these detachable fasteners are of the hook and loop type then an appropriately aligned reciprocal detachable fastener 27 is required on the associated jamb 14,16 to secure the respective surface of the dual latching plane 19 against the jamb. If a magnetic type detachable fastener 15 is employed and the respective jamb is made of a substantially metallic composition then a reciprocal detachable fastener 27 is not required.

Figure 3:
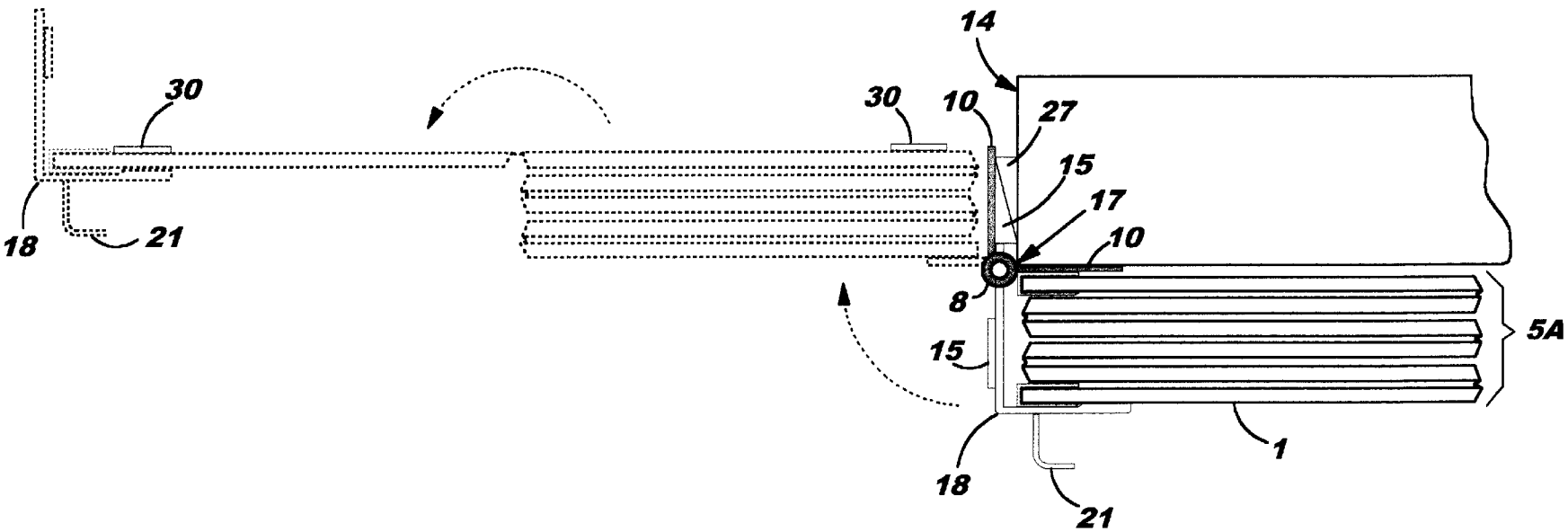
FIG. 3 is a top view illustrating pivotal rotation of the folding door panel about an interior hinge jamb corner.

As shown in FIG. 3, the jamb hinge leaf 10 of each hinge 8 is detachably attached to the hinge jamb 14 as to support pivotal rotation of the attached folding door panel 1 about the interior hinge jamb corner 17. Attachment of the jamb hinge leaf 10 is preferably accomplished using an integrally attached detachable fastener 15, such as the hook and loop type, however a double-sided adhesive tape is also acceptable. If a detachable fastener 15 of the hook and loop type is employed, then reciprocal detachable fastener 27 aligned to the jamb hinge leaf 10 and attached to the hinge jamb 14 is required. If double-sided adhesive tape is employed then reciprocal fasteners are not required.

FIGS. 4A, 4B, 4C

Alternative Embodiments

Figure 4:
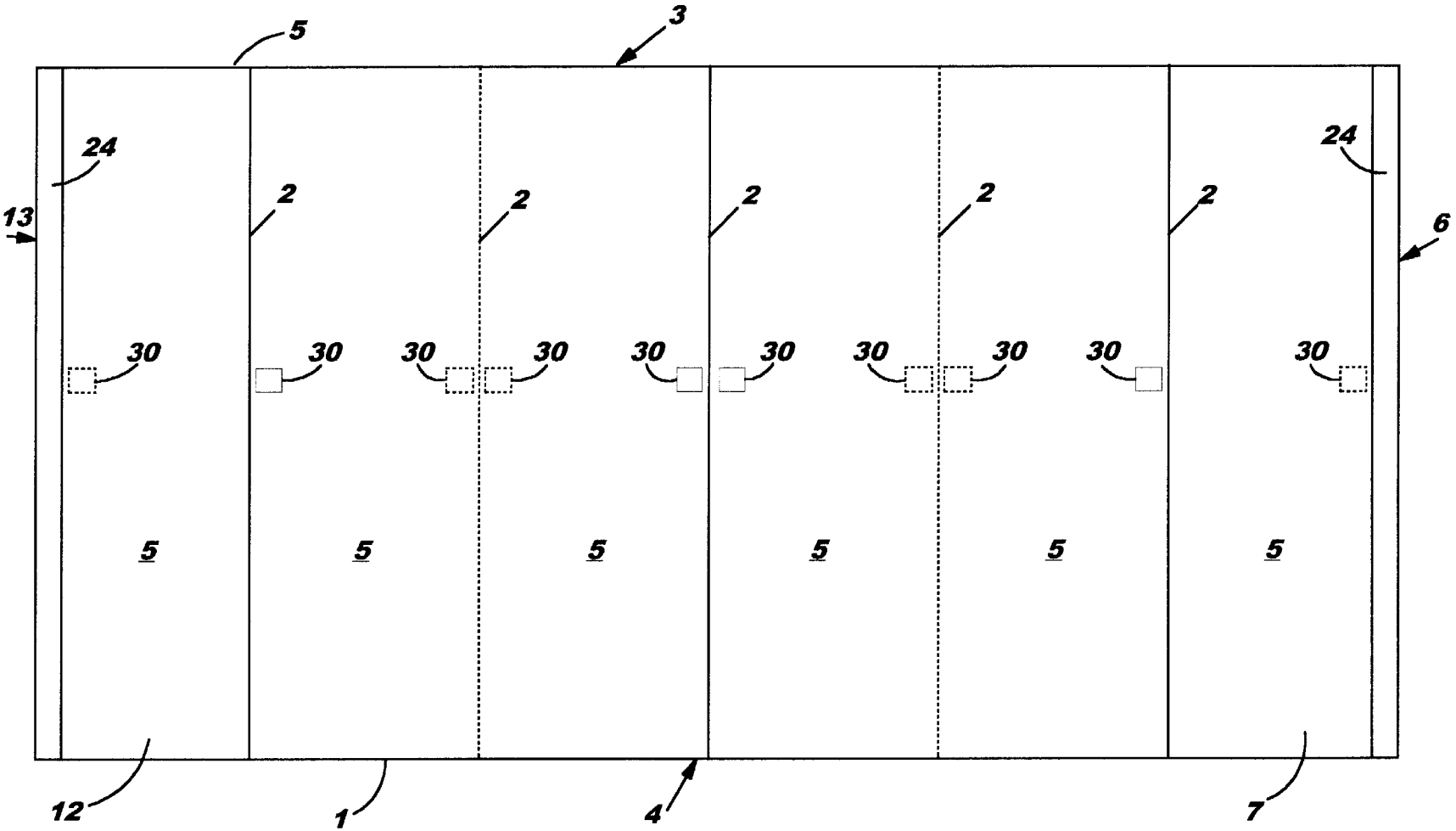
FIG. 4A is a top view of the folding door in an open entryway position with the alternative dual latching handle member.
FIG. 4B is a top view of the folding door in a closed entryway position with the alternative dual latching handle member engaged.
FIG. 4C is a detailed view of the alternative dual latching handle member.
Figure 5:
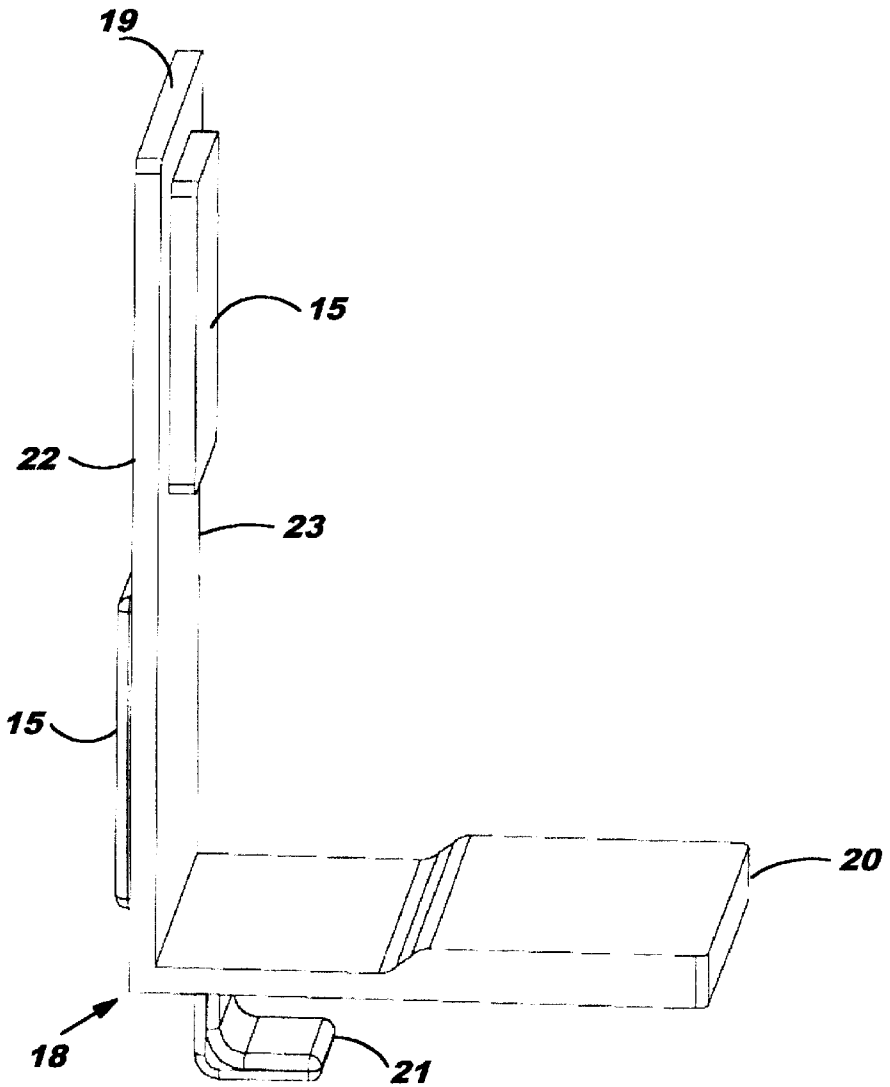
Figure 6A:
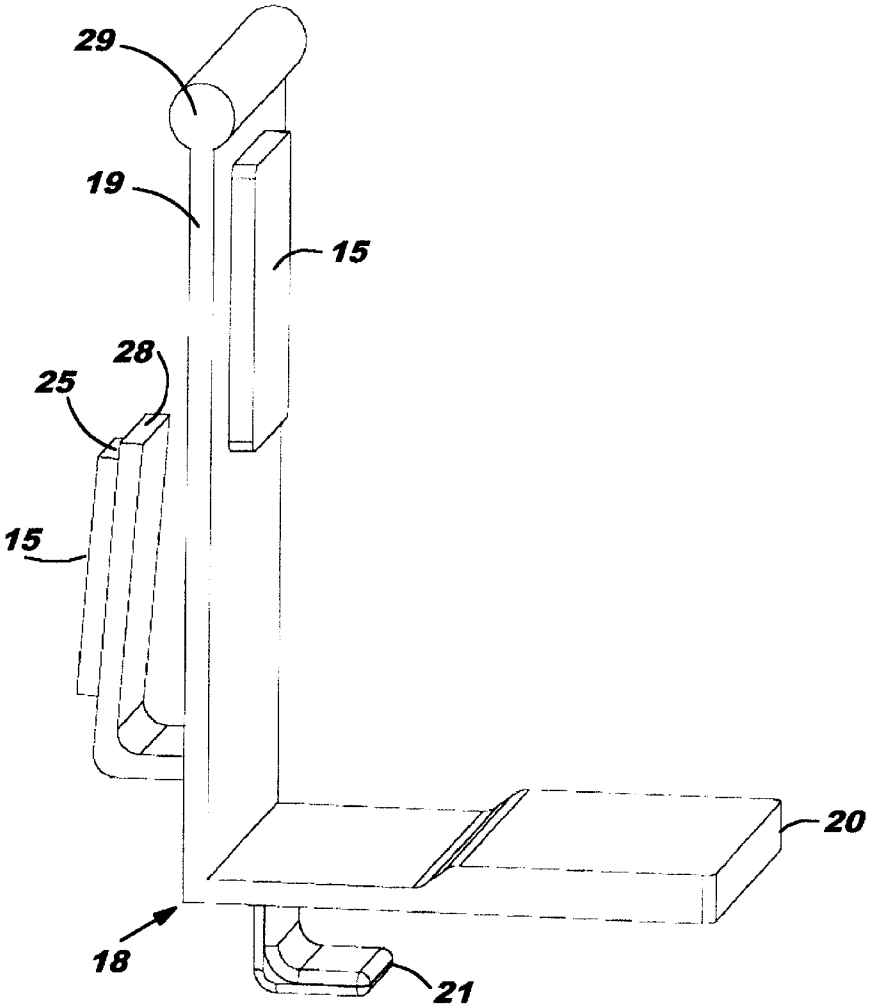
Figure 6B:
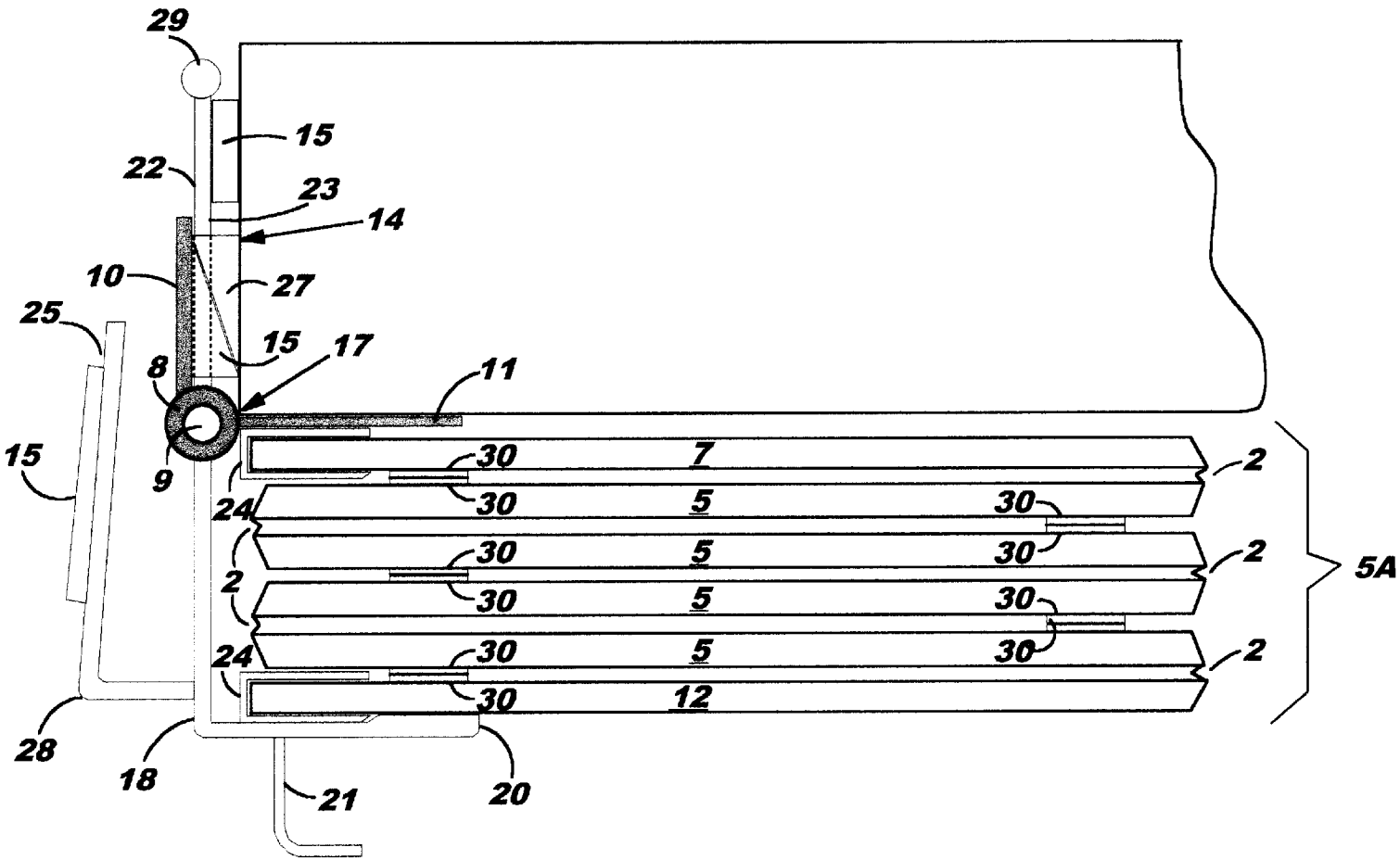
Figure 6C:
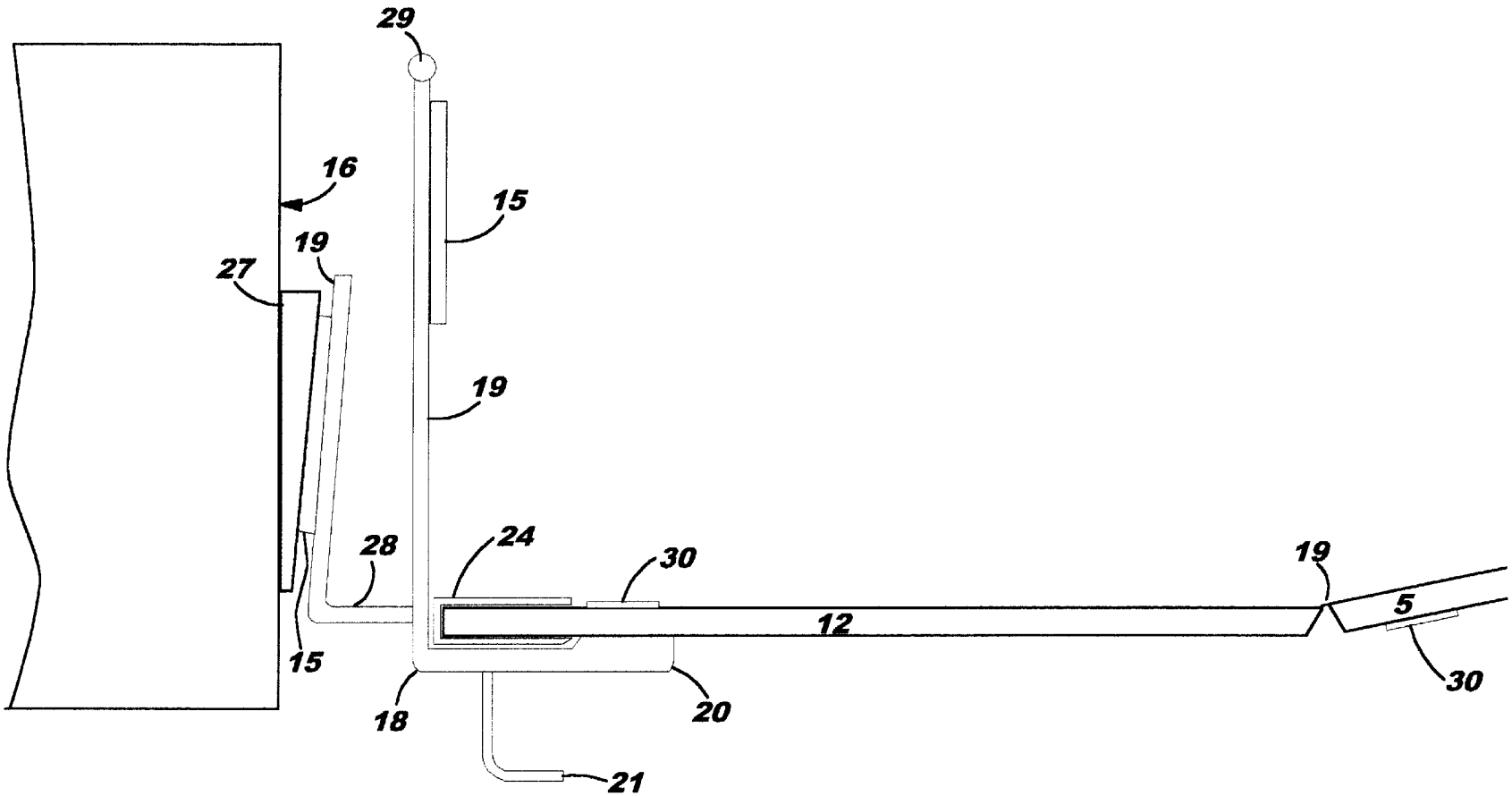

An alternative design of the dual latching handle member 18 is illustrated in FIG. 4C. This design allows the edge of the previously described dual-latching plane 19 to serve as an exterior handle grip. In this design the detachable fastener 27 is moved from the closed door latching surface 22 the to the offset latching surface 25 of the newly introduced offset latching handle 28. When the offset latching surface 25 of the offset latching handle 28 is attached to the handle jamb 16, the edge of dual latching plane 19 is sufficiently spaced from the handle jamb 16 to enable a user's grasp (FIG. 4B).

In addition, the edge of dual latching plane 19 includes a semi-rounded, ridged edge, identified in FIG. 4C as the dual latching plane grip 29. This semi-rounded ridged edge facilitates gripping the edge so it can be used as a handle. Finally, the offset latching handle 28 can be used as alternate door handle, accessible from the cubicle interior, should the folding cubicle door be mounted on an exterior partition surface of the cubicle (FIG. 4A).

Advantages

From the description above, a number of advantages of this folding door for an office cubicle become evident:

(a) This folding door is universally applicable because it can be attached to any partition jamb regardless of partition height or thickness, it can be retained on either the interior or exterior of any sized partition wall and is adjustable to accommodate various cubicle entryway widths.

(b) This folding door is very affordable because it is fabricated from minimal amounts of inexpensive materials such as corrugated cardboard, extruded plastic, lightweight hinges and common releasable fasteners such as magnetic or hook and loop tape.

(c) This folding door is simple to install because its installation follows the familiar paradigm of "peel, position and stick" and it does not require mounting brackets or tools.

(d) This folding door is lightweight and can be mounted to the partition using fasteners that do not require drilling or any other type of permanent modification to the partition.

(e) This folding door is very portable because it is lightweight and can be compressed to a thin, low-width profile.

(f) This folding door is temporary and it can be put up or taken down on demand because detachable fasteners are used to secure the hinge to the partition jamb.

OPERATIONS

FIGS. 1A, 1B, 2A, 2B and FIG. 3

A user can install the folding cubicle door by following three basic steps. First, the user will position the hinge edge 6 of folding door panel 1 along a desired hinge jamb corner 17, 26 such that the surface of jamb hinge leaf 10 which has the attached mated detachable fasteners 15, 27 is facing the hinge jamb 16. After removing the paper backing of the mating detachable fastener 27 to expose its adhesive surface, the user will then position each jamb hinge leaf 10 so that it is parallel and adjacent to the surface of hinge jamb 16. Finally, the user will press the jamb hinge leaf 10 against the hinge jamb 16 as to engage the adhesive capability of the exposed adhesive surface of the mating detachable fastener 27. The result of this installation process is shown in detail in FIGS. 2A and 2B.

To retain the folding cubicle door in the open entryway position as show in FIGS. 2A and 2B, the user first folds and collapses the folding door panel 1, in accordion style, to create a generally compressed stack of panel elements 5A. Next the generally compressed stack of panel elements 5A is pivoted about the hinge jamb corner 17 so that the stack is positioned out of the entryway, adjacent and overlapping the partition surface. The compressed stack of panel elements 5A is then firmly pressed against the partition surface.

The pressure applied during compression against the partition surface engages the retaining properties the magnetic fasteners 30 that serve retain the folding door panel in the compression configuration. Finally, the open door retaining surface 23 of the dual latching handle member 18 is detachably attached to the hinge jamb 16. This attachment serves to eliminate unwanted pivotal movement of the compressed stack of panel elements 5A because it is sandwiched between the door handle grip plane 20 component of the of the dual latching handle member 18 and the surface of the partition wall.

Figure 1B:
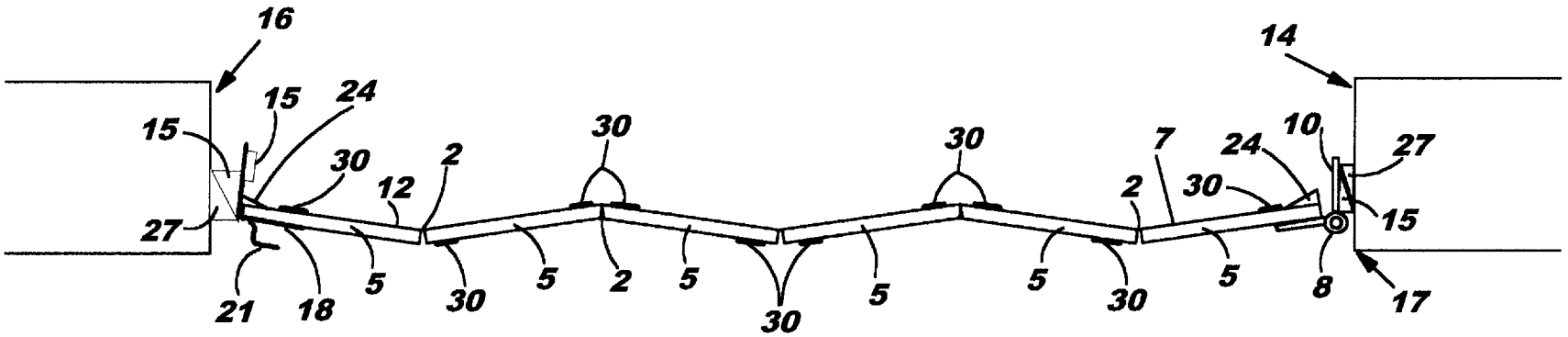
FIG. 1B is a top view of the folding door in a closed entryway position.

The following steps are required to retain folding cubicle door in the closed entryway position as shown in FIG. 1A and FIG. 1B when starting from the open door position as shown in FIG. 2A. First, the user detaches the open door retaining surface 23 of the dual latching handle member 18 from the hinge jamb 16 by gripping the door handle grip 21 and urging it away from the from the hinge jamb 16. While continuing to hold the door handle grip 21, the user guides the closed door latching surface 22 directly towards the surface of the handle jamb 16 so that the closed door latching surface 22 is positioned adjacent the handle jamb 16.

This action causes the compressed stack of panel elements 5A to be pivotally positioned into the entryway as shown in FIG. 3. The folding door panel 1 is then stretched and unfolded such that the series of contiguous panel elements 5 are disposed in a generally coplanar arrangement along the threshold of the entryway towards the handle jamb 16. Finally, the user detachably attaches the closed door latching surface 22 of the dual latching handle member 18 to the handle jamb 16 which causes the folding cubicle door to be retained this stretched, closed entryway configuration as shown in FIG. 1A and FIG. 1B.

Conclusion, Ramifications, and Scope

Because the folding cubicle door of this invention can accommodate most existing cubicle partition systems and configurations, it can be used to significantly reduce peripheral distractions and ad-hoc interruptions in the modular office environment and thereby increase worker productivity.

By positioning the folding cubicle door as to close off the entryway, peripheral distractions are eliminated from user view. In addition, a closed door can be used to signify to coworkers that the user is busy working and does not wish to be needlessly disturbed. When not is use, the folding cubicle door is easily stored out of the user's way in a collapsed, minimal-width profile where it is ready for deployment on demand. Furthermore, the folding cubicle door of this invention has additional advantages in that:

- it is affordable and can be purchased by an average user, it can be transported to the workplace by an average user; it can be installed without tools by an average user;
- it can be installed without modifying or marring the cubicle partition so the partition is not left disfigured when the door is taken down;
- it is inexpensive so that personal financial loss is limited if management personal does not sanction usage of the folding door in the particular workplace;
- it can be taken down on demand, reinstalled, and is very portable in the case that a user is reassigned to a different cubicle or leaves the facility;
- it has a panel surface which facilitates decoration by an inexpensive conventional printing means and thus can be decorated to reflect a diverse set of user interests and personal tastes;

it is inexpensive to produce and has a panel surface which facilitates decoration by a conventional printing means and thus can be used as a promotional item with its minimal fabrication costs supported by sponsors.

Although the above description contains many specifics, these should not be construed as limiting the scope of the invention but as merely providing illustrations of some of the presently preferred embodiments of this invention.

We claim:

1. A folding door for an office cubicle comprising:

a configuration of vertical office partitions subdividing an open space into office cubicles, each cubicle having an entryway permitting user passage, each entryway defined as the open space between a first partition having a first partition jamb and a second partition having a second partition jamb;

a folding door panel, fabricated from a generally rectangular sheet of lightweight, semi-rigid material which substantially covers said entryway when positioned as a vertical plane between said first partition jamb and said second partition jamb; said folding door panel having a first longitudinal edge parallel to a second longitudinal edge and a first latitudinal edge parallel to a second latitudinal edge, including a plurality of foldable joint lines, extending from said first latitudinal edge to said second latitudinal edge and parallel to the longitudinal edges such that said plurality of foldable joint lines partition said folding door panel into a plurality of contiguous, rectangular panel elements;

wherein said folding door panel is foldable, in according style, along said plurality of foldable joint lines such that collapsing and urging compression of said folding door panel along said foldable joint lines disposes said rectangular panel elements in a compressed stacked relation;

a vertical hinge means for providing vertically supported pivotal movement of said folding door panel about a vertical axis established adjacent to said first partition jamb, including a fastener and attaching said first longitudinal edge to said first partition jamb;

a retaining means for releasably securing said rectangular panel elements in the compressed stacked relation thereby maintaining an open entryway position; a latching member comprising two intersecting perpendicular planar members terminating at intersection, having a first planar member integrally attached to surface of said folding door panel along said second longitudinal edge, and a second planar member disposed perpendicular to the surface said folding door panel; said second planar member having first planar surface facing said first partition jamb, and a second planar surface facing said second partition jamb, said second surface including an integrally attached reusable, detachable-attachable fastener, wherein detachably-attaching said second planar surface of said second planar member to said second partition jamb secures said rectangular panel elements in a generally coplanar arrangement disposed vertically perpendicular to said second partition jamb, thereby maintaining a closed entryway position.

2. The folding cubicle door of claim 1 further including an integrally attached reusable, detachable-attachable type fastener attached to said first planar surface whereby detachably-attaching said first planar surface of said second planar member to said first partition jamb sandwiches and secures said rectangular panel elements, disposed in said compressed stacked relation, between said first planar member and said first partition, thereby maintaining an open entryway position.

3. The folding cubicle door of claim 1 further including a plurality of specifically aligned reusable, detachable-attachable type fasteners integrally attached to the surfaces of said rectangular panel elements such that said rectangular panel elements are releasably secured in the compressed stacked relation thereby maintaining an open entryway position.

4. The folding cubicle door of claim 1 further including a raised planar surface offset from said second planar member whereby said second planar surface of said second planar member is sufficiently spaced from said second partition jamb to be used as a handle when said raised planar surface is detachably-attached to said second partition jamb.

5. The folding cubicle door of claim 1 further including in combination: an elongated channel means for providing longitudinal rigidity attached to said first longitudinal edge, an elongated channel means for providing longitudinal rigidity attached to said second longitudinal edge, an interior handle means for providing user grip during opening and closing operations from the interior of the cubicle, a exterior handle means for providing user grip during opening and closing operations from the exterior of the cubicle.

6. The folding cubicle door of claim 1 wherein the fastener attaching said first longitudinal edge to said first partition jamb is of the removable, non-marring, adhesive-backed type.

7. The folding cubicle door of claim 1 wherein the fastener attaching said first longitudinal edge to said first partition jamb is of the hook and loop fastener type.

8. The folding cubicle door of claim 1 wherein the fastener attaching said first longitudinal edge to said first partition jamb is of the magnetic fastener type.

9. The folding cubicle folding cubicle door of claim 1 wherein said integrally attached reusable, detachable-attachable fastener is of the magnetic fastener type.

10. The folding cubicle folding cubicle door of claim 1 wherein said integrally attached reusable, detachable-attachable fastener is of the magnetic fastener type.

11. The folding cubicle folding cubicle door of claim 2 wherein said integrally attached reusable, detachable-attachable fastener attached to said fist planar surface is of the hook and loop fastener type.

12. The folding cubicle folding cubicle door of claim 2 wherein said integrally attached reusable, detachable-attachable fastener attached to said first planar surface is of the magnetic fastener type.

13. The folding cubicle folding cubicle door of claim 3 wherein the specifically aligned reusable, detachable-attachable type fasteners are of the magnetic fastener type.

14. The folding cubicle folding cubicle door of claim 3 wherein the specifically aligned reusable, detachable-attachable type fasteners are of the hook and loop type.

15. A folding cubicle door for an office cubicle comprising:

a configuration of vertical office partitions subdividing an open space into office cubicles, each cubicle having an entryway permitting user passage, each entryway defined as the open space between a first partition having a first partition jamb and a second partition having a second partition jamb;

a folding door panel, having a first longitudinal edge parallel to a second longitudinal edge, including a plurality of coplanar, rectangular planar elements jointed to each other along adjacent longitudinal edges by a foldable jointing means integrally attached to alternating planar surfaces thereof;

wherein said folding door panel is horizontally collapsible, such that longitudinally folding each of said foldable jointing means upon itself disposes said rectangular planar elements in a flattened, accordion styled, stacked relation;

a vertical hinge means, attaching said first longitudinal edge to said first partition jamb, for providing vertically supported pivotal movement of said folding door panel about a vertical axis established adjacent to said first partition jamb;

a latching means for releasably securing said folding cubicle door such that it is maintained stretched and unfolded in the closed entryway position;

wherein said latching means detachably attaches said second longitudinal edge to said second partition jamb such that said rectangular panel elements are retained disposed unfolded in a generally coplanar arrangement, perpendicular to said second partition jamb; and a retaining means for releasably securing said folding cubicle door in the open entryway position such that said rectangular panel elements disposed adjacent to said first partition in the flattened, accordion styled, stacked relation.

16. The folding cubicle door of claim 15 wherein said folding cubicle door is sufficiently light as to be supported in the open and closed entryway positions by a removable, non-marring fastener attaching said vertical hinge means to said first partition jamb.

17. The folding cubicle door of claim 15 further including in combination: an elongated channel means for providing longitudinal rigidity attached to said first longitudinal edge, an elongated channel means for providing longitudinal rigidity attached to said second longitudinal edge, an interior handle means for providing user grip during opening and closing operations from the interior of the cubicle, a exterior handle means for providing user grip during opening and closing operations from the exterior of the cubicle.

* * * * *